US009360816B1

(12) United States Patent
Mabuchi et al.

(10) Patent No.: US 9,360,816 B1
(45) Date of Patent: Jun. 7, 2016

(54) TONER BOTTLE DRIVING DEVICE CONTROL METHOD AND IMAGE FORMING APPARATUS

(71) Applicants: Hiroyuki Mabuchi, Kanagawa (JP); Hiroaki Okamoto, Kanagawa (JP); Junichi Terai, Kanagawa (JP); Yukio Otome, Ibaraki (JP); Tadashi Ogawa, Tokyo (JP); Hiroshi Kikuchi, Kanagawa (JP); Hideki Kimura, Kanagawa (JP); Katsuya Akiba, Kanagawa (JP)

(72) Inventors: Hiroyuki Mabuchi, Kanagawa (JP); Hiroaki Okamoto, Kanagawa (JP); Junichi Terai, Kanagawa (JP); Yukio Otome, Ibaraki (JP); Tadashi Ogawa, Tokyo (JP); Hiroshi Kikuchi, Kanagawa (JP); Hideki Kimura, Kanagawa (JP); Katsuya Akiba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/969,358

(22) Filed: Dec. 15, 2015

(30) Foreign Application Priority Data

Dec. 15, 2014 (JP) ..... 2014-252701
Jan. 29, 2015 (JP) ..... 2015-015725

(51) Int. Cl.
*G03G 15/08* (2006.01)
*G03G 15/00* (2006.01)

(52) U.S. Cl.
CPC ..... *G03G 15/55* (2013.01); *G03G 15/0831* (2013.01); *G03G 15/0837* (2013.01); *G03G 15/0839* (2013.01)

(58) Field of Classification Search
CPC ..... G03G 15/0837; G03G 15/0839
USPC ..... 399/27, 258, 262
See application file for complete search history.

(56) References Cited

U.S. PATENT DOCUMENTS 7,433,630 B2 * 10/2008 Pargett ..... G03G 15/0896 399/167
2008/0175628 A1 7/2008 Kita et al.

(Continued)

FOREIGN PATENT DOCUMENTS

JP 2005-173362 6/2005
JP 2013-257458 12/2013

(Continued)

OTHER PUBLICATIONS

U.S. Appl. No. 14/807,317, filed Jul. 23, 2015.

*Primary Examiner* — Hoang Ngo
(74) *Attorney, Agent, or Firm* — Oblon, McClelland, Maier & Neustadt, L.L.P

(57) ABSTRACT

A toner bottle driving device control method includes driving one of multiple toner bottle driving devices connected to a single toner container at a time, detecting abnormality of a toner bottle driving device being driven, determining a first abnormality phase of the toner bottle driving device being driven when a number of times the abnormality is detected exceeds a threshold, inhibiting the toner bottle driving device being in the first abnormality phase from driving until the first abnormality phase is resolved, driving a drivable toner bottle driving device containing a non-empty toner bottle when the toner bottle contained in the toner bottle driving device being driven is determined as empty, determining that the multiple toner bottle driving devices are in a second abnormality phase when each of the multiple toner bottle driving devices is determined as being in the first abnormality phase, and inhibiting image formation.

11 Claims, 10 Drawing Sheets

(56) References Cited

U.S. PATENT DOCUMENTS

| | | | |
|---|---|---|---|
| 2009/0087214 | A1 | 4/2009 | Utsunomiya et al. |
| 2010/0003055 | A1 | 1/2010 | Kikuchi et al. |
| 2010/0129118 | A1 | 5/2010 | Kimura et al. |
| 2011/0123234 | A1 | 5/2011 | Terai |
| 2011/0222871 | A1 | 9/2011 | Suzuki et al. |
| 2012/0051792 | A1 | 3/2012 | Matsumoto et al. |
| 2012/0163874 | A1 | 6/2012 | Hattori et al. |
| 2012/0163877 | A1 | 6/2012 | Kikuchi et al. |
| 2012/0195645 | A1 | 8/2012 | Takami et al. |
| 2012/0230733 | A1 | 9/2012 | Kikuchi et al. |
| 2014/0064794 | A1 | 3/2014 | Takahashi et al. |
| 2014/0079414 | A1* | 3/2014 | Amauchi ..... G03G 15/0877 399/27 |
| 2014/0119780 | A1 | 5/2014 | Hori et al. |
| 2014/0233984 | A1 | 8/2014 | Miyoshi et al. |
| 2015/0023700 | A1 | 1/2015 | Nakamoto et al. |
| 2015/0063875 | A1 | 3/2015 | Ohshima et al. |
| 2015/0147096 | A1 | 5/2015 | Hori et al. |
| 2015/0234318 | A1 | 8/2015 | Takahashi et al. |

FOREIGN PATENT DOCUMENTS

| | | |
|---|---|---|
| JP | 2014-157350 | 8/2014 |
| JP | 2014-178612 | 9/2014 |

* cited by examiner

| FIG. 8A |
| --- |
| FIG. 8B |

TONER BOTTLE DRIVING DEVICE CONTROL METHOD AND IMAGE FORMING APPARATUS

CROSS-REFERENCE TO RELATED APPLICATIONS

This patent application is based on and claims priority pursuant to 35 U.S.C. §119(a) to Japanese Patent Application Nos. 2014-252701 filed on Dec. 15, 2014 and 2015-015725 filed on Jan. 29, 2015, in the Japan Patent Office, the entire disclosure of each of which is hereby incorporated by reference herein.

BACKGROUND

1. Technical Field

Embodiments of the present invention generally relate to a toner bottle driving device control method and an image forming apparatus that employs the toner bottle driving device control method.

2. Description of the Related Art

There are image forming apparatuses that include a toner filling device or a toner supply device to supply toner to a developing device inside the apparatus from a toner bottle having a toner outlet positioned on an end side of the toner bottle. For example, the toner filling device or the toner supply device rotates the toner bottle to discharge the toner from the toner outlet of the toner bottle into a toner container of the toner filling device or the toner supply device.

SUMMARY

An embodiment of the present invention provides a toner bottle driving device control method of controlling multiple toner bottle driving devices connected to a single toner container. The multiple toner bottle driving devices contain toner bottles, respectively. The method includes driving one of the multiple toner bottle driving devices connected to the single toner container at a time; detecting a driving status value of the toner bottle driving device being driven at regular intervals; storing, in a memory device, an abnormality detection count representing a count of times the detected driving status value exceeds an abnormality criterial value; resetting the abnormality detection count when the driving status value falls to or below the abnormality criterial value; determining that the toner bottle driving device being driven is in a first abnormality phase when the stored abnormality detection count exceeds a threshold; storing, in the memory device, the first abnormality phase as a status of the toner bottle driving device being driven; indicating the first abnormality phase of the toner bottle driving device being driven on a display of an image forming apparatus including the multiple toner bottle driving devices; determining that the toner bottle in the toner bottle driving device being in the first abnormality phase is empty regardless of an amount of toner remaining in the toner bottle; inhibiting the toner bottle driving device being in the first abnormality phase from driving until the first abnormality phase is resolved; driving a drivable toner bottle driving device containing a non-empty toner bottle, out of the multiple toner bottle driving devices, when the toner bottle contained in the toner bottle driving device being driven is determined as empty; determining that the multiple toner bottle driving devices are in a second abnormality phase when each of the multiple bottle driving devices is in the first abnormality phase; and indicating the second abnormality phase on the display; and inhibiting image forming operation in the image forming apparatus until the second abnormality phase is resolved.

In another embodiment, a toner bottle driving device control method includes driving one of multiple toner bottle driving devices connected to a single toner container at a time; detecting whether the toner bottle driving device being driven has an abnormality; determining a first abnormality phase of the toner bottle driving device being driven when the number of times the abnormality of the toner bottle driving device being driven is detected exceeds a threshold; inhibiting the toner bottle driving device being in the first abnormality phase from driving until the first abnormality phase is resolved; driving a drivable toner bottle driving device containing a non-empty toner bottle, out of the multiple toner bottle driving devices, when the toner bottle contained in the toner bottle driving device being driven is determined as empty; determining that the multiple toner bottle driving devices are in a second abnormality phase when each of the multiple toner bottle driving devices is in the first abnormality phase; and inhibiting image formation in an image forming apparatus.

Yet another embodiment concerns an image forming apparatus that includes a single toner container to contain toner, multiple bottle driving devices connected to the single toner container, a controller to control driving of the multiple bottle driving devices, and an abnormality detector to detect an abnormality of the toner bottle driving device being driven.

The controller drives one of the multiple bottle driving devices at a time and determines that the toner bottle driving device being driven is in a first abnormality phase when a number of times the abnormality detector detects the abnormality of the toner bottle driving device being driven exceeds a threshold. The controller stops the bottle driving device being in the first abnormality phase and drives a drivable toner bottle driving device containing a non-empty toner bottle, out of the multiple toner bottle driving devices. When each of the multiple toner bottle driving devices is in the first abnormality phase, the controller determines that the multiple toner bottle driving devices are in a second abnormality phase and inhibits image formation of the image forming apparatus.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
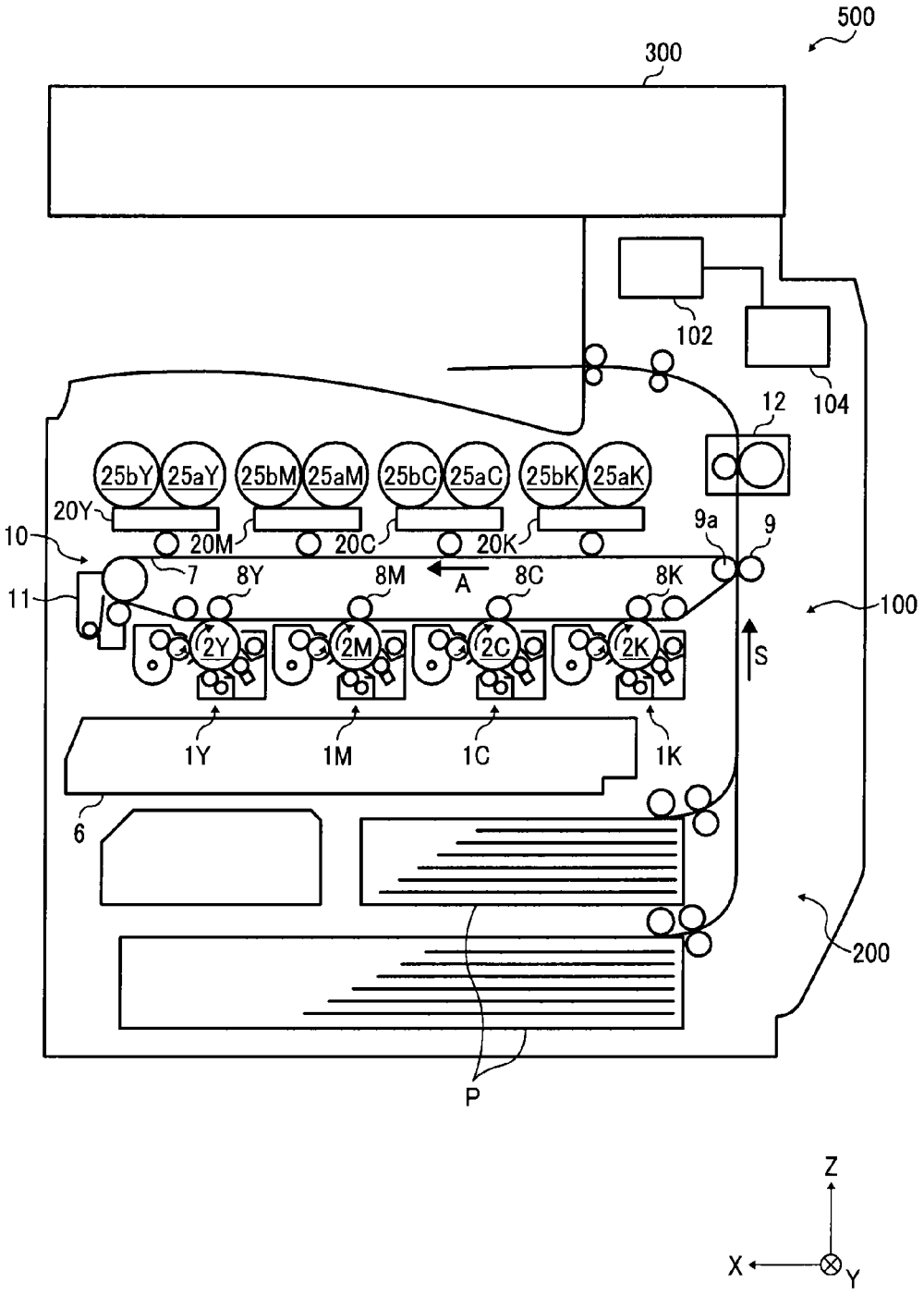
FIG. 1 is a schematic diagram that illustrates a configuration of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

Initially, a configuration and operation of the image forming apparatus according to the present embodiment are described below.

FIG. 1 is a schematic diagram that illustrates a configuration of an image forming apparatus 500 according to the present embodiment.

The image forming apparatus 500 includes a printer body 100, a sheet feeding table (hereinafter "sheet feeder 200"), and a scanner 300 attached on the printer body 100. The printer body 100 includes four process cartridges 1Y, 1M, 1C, and 1K for forming yellow, magenta, cyan, and black toner images, respectively. The process cartridges 1Y, 1M, 1C, and 1K (hereinafter also collectively "process cartridges 1") include drum-shaped photoconductors 2Y, 2M, 2C, and 2K, serving as image bearers, respectively.

The apparatus body 100 further includes an intermediate transfer belt 7 serving as an intermediate transfer member, an exposure device 6, and a fixing device 12. The intermediate transfer belt 7 rotates in the direction indicated by arrow A illustrated in FIG. 1 (hereinafter "belt travel direction").

The exposure device 6 is disposed below the process cartridges 1 in FIG. 1. The exposure device 6 serves as a latent image forming unit and directs laser beams L to the photoconductors 2Y, 2M, 2C, and 2K in the process cartridges 1, respectively, according to image data, thereby forming electrostatic latent images thereon. Accordingly, the electrostatic latent images for yellow, magenta, cyan, and black are formed on the photoconductors 2Y, 2M, 2C, and 2K, respectively.

More specifically, the exposure device 6 includes multiple optical lenses, multiple mirrors, and a polygon mirror that is rotated by a motor and directs the laser beams L emitted from respective light sources to the respective photoconductors 2 via the multiple optical lenses and mirrors while deflecting the laser beams L with the polygon mirror.

Above the process cartridges 1Y, 1M, 1C, and 1K, an intermediate transfer unit 10 including the intermediate transfer belt 7 is disposed. The intermediate transfer belt 7 is an intermediate transfer member and rotates in the direction indicated by arrow A, supported by multiple rollers. The intermediate transfer unit 10 includes four primary-transfer bias rollers 8Y, 8M, 8C, and 8K, a belt cleaner 11, and the like in addition to the intermediate transfer belt 7. The intermediate transfer unit 10 further includes a secondary-transfer backup roller 9*a* and a cleaning backup roller 11*a*.

The four primary-transfer bias rollers 8 are pressed against the corresponding photoconductors 2 via the intermediate transfer belt 7, and four contact portions between the primary-transfer bias rollers 8 and the corresponding photoconductors 2 are hereinafter referred to as primary transfer nips.

Each primary-transfer bias roller 8 applies a transfer bias opposite (for example, positive) in polarity to the toner to a back surface (inside the loop) of the intermediate transfer belt 7. As the intermediate transfer belt 7 rotates and passes the four primary transfer nips sequentially, the yellow, magenta, cyan, and black toner images are transferred from the photoconductors 2Y, 2M, 2C, and 2K and superimposed one on another on the intermediate transfer belt 7 (primary transfer process). Thus, a superimposed four-color toner image is formed on the intermediate transfer belt 7.

The secondary-transfer backup roller 9*a* is pressed to a secondary transfer roller 9 with the intermediate transfer belt 7 nipped therebetween. The nipped portion is called a secondary transfer nip.

In the sheet feeder 200 located below the printer body 100, transfer sheets P (recording media) are piled one on another. The sheet feeder 200 timely feeds the transfer sheets P to the secondary transfer nip.

The four-color toner image on the intermediate transfer belt 7 is transferred onto the transfer sheet P in the secondary transfer nip (secondary transfer process). A certain amount of toner tends to remain untransferred (i.e., residual toner) on the intermediate transfer belt 7 that has passed the secondary transfer nip, and the belt cleaner 11 removes the residual toner. The fixing device 12 is positioned downstream from the secondary transfer nip in the direction indicated by arrow S, in which the transfer sheet P is transported. The four-color toner image is fixed on the transfer sheet P with heat and pressure while the transfer sheet P passes between rollers of the fixing device 12, after which the transfer sheet P is discharged outside the image forming apparatus 500. In FIG. 1, the image forming apparatus 500 further includes a display device 102 and a controller 104.

Descriptions are given of the process cartridges 1 below.

The process cartridges 1Y, 1C, 1M, and 1K are similar in configuration except that the color of toner used therein is different. Therefore, subscripts Y, M, C, and K attached to the reference numerals thereof are omitted in the description below.

Figure 2:
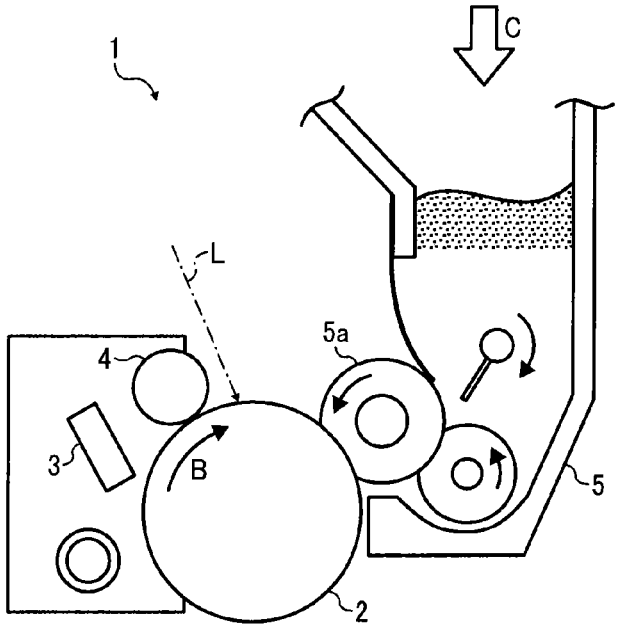
FIG. 2 is a schematic view of a process cartridge according to an embodiment.

FIG. 2 is a schematic view illustrating a configuration of the process cartridge 1.

The process cartridge 1 includes a drum-shaped photoconductor 2, a drum cleaning device 3, a discharger, a charging device 4, and a developing device 5. The process cartridge 1 is removably insertable into the printer body 100, and thus consumables can be replaced at a time. The photoconductor 2 rotates clockwise in the drawing as indicated by arrow B.

The charging device 4 can be a charging roller. The charging device 4 is pressed against the surface of the photoconductor 2 and rotates as the photoconductor 2 rotates. In image formation, a high-voltage power source applies a predetermined bias voltage to the charging device 4, and the charging device 4 electrically charges the surface of the photoconductor 2 uniformly.

Subsequently, the exposure unit 6 scans the surface of the photoconductor 2 with the laser beam L, thereby forming an electrostatic latent image thereon. The developing device 5 includes a developing roller 5*a* to bear toner, with which the electrostatic latent image is developed into a toner image.

The toner image is then transferred onto the intermediate transfer belt 7. Then, the drum cleaner 3 removes the toner remaining on the surface of the photoconductor 2 (i.e., cleaning process) after the intermediate transfer process. The discharger statically eliminates electric charges remaining on the photoconductor 2 after the cleaning process. The surface of the photoconductor 2 is initialized in preparation for the subsequent image formation.

The four process cartridges 1 form yellow, cyan, magenta, and black toner images on the respective photoconductors 2.

The four process cartridges 1 are arranged side by side in the belt travel direction indicated by arrow A. The toner images formed on the photoconductors 2 are transferred therefrom and superimposed sequentially one on another on the intermediate transfer belt 7 (primary transfer process). Thus, a visible image (four-color toner image) is formed on the intermediate transfer belt 7. The four-color toner image on the intermediate transfer belt 7 is transferred onto the transfer sheet P in the secondary transfer nip (secondary transfer process).

In the four process cartridges 1Y, 1M, 1C, and 1K, as the toner images are formed in the above-described processes, toner contained in each of the developing devices 5Y, 5M, 5C, and 5K is consumed. Accordingly, the toner is supplied to each of the developing devices 5Y, 5M, 5C, and 5K to compensate for the consumption.

It is preferred that the amount of toner supplied to the developing device 5 be neither excessive nor insufficient. For example, if an excessive amount of toner is supplied to the developing device 5, in two-component developing, the density or percentage of toner increases, and image density increases. In one-component developing, the amount of charge of toner, the amount of toner transported, or both change, causing image density to decrease or background stains to worsen.

On the other hand, if the amount of toner supplied is insufficient, in two-component developing, the density of toner tends to decease, thereby reducing image density. In one-component developing, density tends to increase. Therefore, regardless of developing type, the amount of toner supplied to the developing device 5 is preferably neither excessive nor insufficient to inhibit fluctuations in image quality.

As illustrated in FIG. 1, first and second toner bottles 25*a*Y and 25*b*Y, first and second 25*a*M and 25*b*M, first and second 25*a*C and 25*b*C, and first and second 25*a*K and 25*b*K (hereinafter also collectively "first and second toner bottles 25*a* and 25*b*") containing respective color toners are disposed above the intermediate transfer belt 7. The first and second toner bottles 25*a* and 25*b* are provided for each of yellow, magenta, cyan, and black toners.

The image forming apparatus 500 further includes toner supply devices 20Y, 20M, 20C, and 20K (hereinafter also collectively "toner supply devices 20"), each of which supplies the toner from the toner bottles 25*a* and 25*b* to the developing device 5 of the corresponding color as indicated by arrow C in FIGS. 2 and 3.

Next, the toner supply devices 20Y, 20M, 20C, and 20K are described below in further detail.

The toner supply devices 20Y, 20M, 20C, and 20K are similar in configuration except that the color of toner used therein is different. Therefore, subscripts Y, M, C, and K attached to the reference numerals thereof are omitted in the description below.

Figure 3:
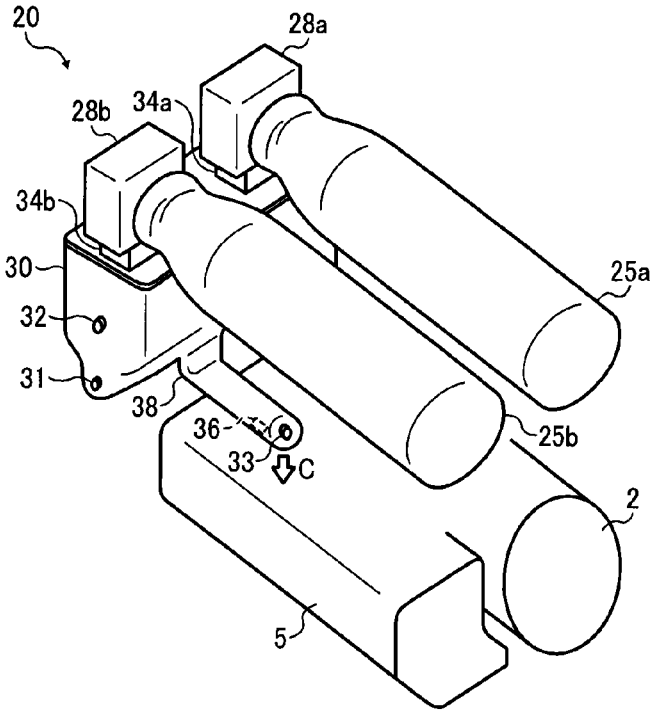
FIG. 3 is a schematic perspective view of a toner supply device according to an embodiment.
Figure 4B:
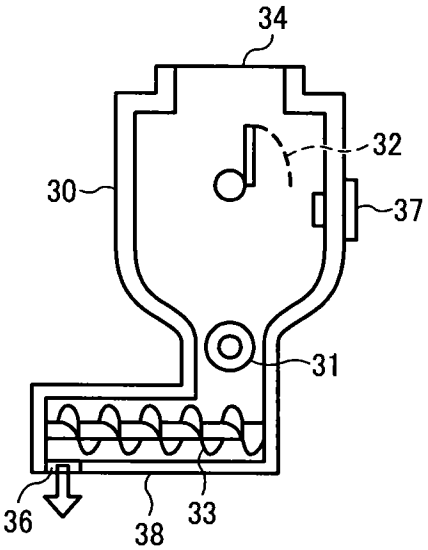
FIGS. 4A and 4B are schematic views illustrating a configuration of a toner container according to an embodiment.
Figure 4A:
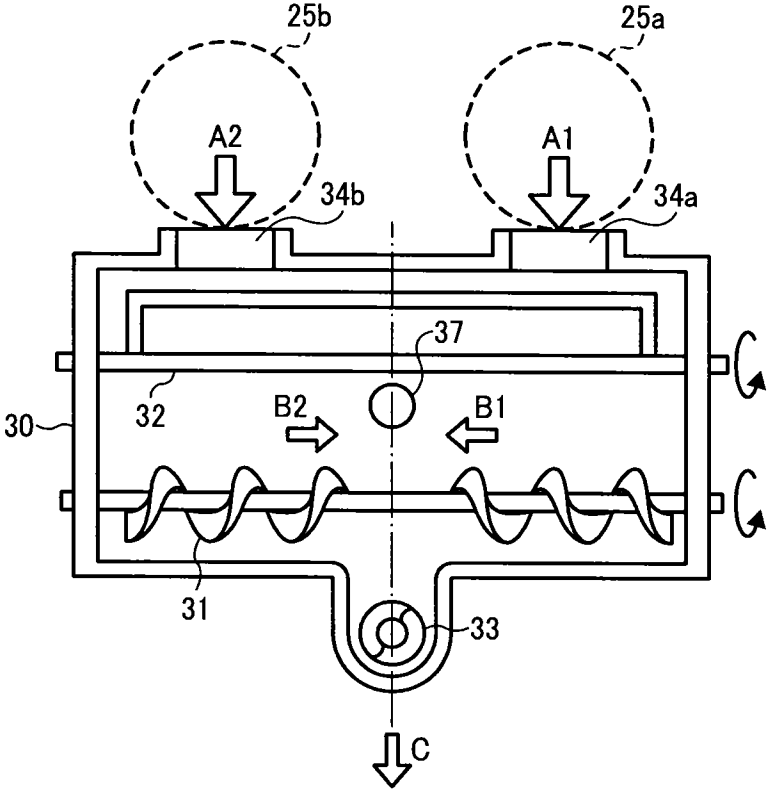

FIG. 3 is a schematic view illustrating a configuration of the toner supply device 20. FIGS. 4A and 4B are schematic views illustrating a configuration of a toner container 30. Specifically, FIG. 4A is a cross-sectional view along the direction in which the first and second toner bottles 25*a* and 25*b* are arranged. FIG. 4B is a cross-sectional view along the longitudinal direction of the first and second toner bottles 25*a* and 25*b*.

As described above, the toner supply device 20 drives one of the first and second the toner bottles 25*a* and 25*b* to supply the toner to the toner container 30 and supplies the toner from the toner container 30 to the developing device 5.

An aspect of the present embodiment is an empty determination method, that is, a method of determining that the toner bottle 25 is empty. Another aspect is a method of determining abnormality (abnormal state) of first and second bottle driving devices 28*a* and 28*b* (illustrated in FIGS. 3 and 5B, also collectively "bottle driving devices 28") to drive the first and second the toner bottles 25*a* and 25*b*, respectively.

In a configuration in which a bottle driving device rotates a toner bottle to supply toner therefrom to a toner container, there is a possibility of overload of the bottle driving device, and the bottle driving device fails to rotate the toner bottle properly.

For example, the overload is caused by severe abnormalities such as toner aggregations unsolvable by continuous driving of the toner bottle driving device and a lingering defect of a driving mechanism to drive the toner bottle driving device. Alternatively, the overload is caused by a minor abnormality or a transient phenomenon such as toner aggregations solvable by continuous driving of the toner bottle driving device.

The following inconveniences are possible in the configuration in which driving is switched among the multiple bottle driving devices, to use multiple toner bottles sequentially, in the case of overload of the bottle driving device being driven.

It is possible that the bottle driving device having a severe abnormality is kept driving, and toner is not supplied to the toner container. Further, the motor and the driving mechanism to drive the bottle driving device are damaged. By contrast, if the driving of the bottle driving device having a transient abnormality is stopped upon detection of the overload, image formation becomes unfeasible.

[Empty Determination Method]

When the controller 104 determines that the toner bottle 25 in use is empty, toner is supplied from the other toner bottle 25. Specifically, the toner container 30 includes a toner sensor 37 to detect the toner contained in the toner container 30. The controller 104 determines whether or not the toner bottle 25 in use is empty based on outputs from the toner sensor 37, as follows.

The number of times the output from the toner sensor 37 indicates "empty" (no toner) is counted. The controller 104 determines that the toner bottle 25 is empty in a case where the toner sensor 37 successively indicates "empty" for a predetermined number of times (i.e., threshold number) while the toner is supplied from the toner bottle 25 to the toner container 30.

[Abnormality Determination Method]

Figure 10:
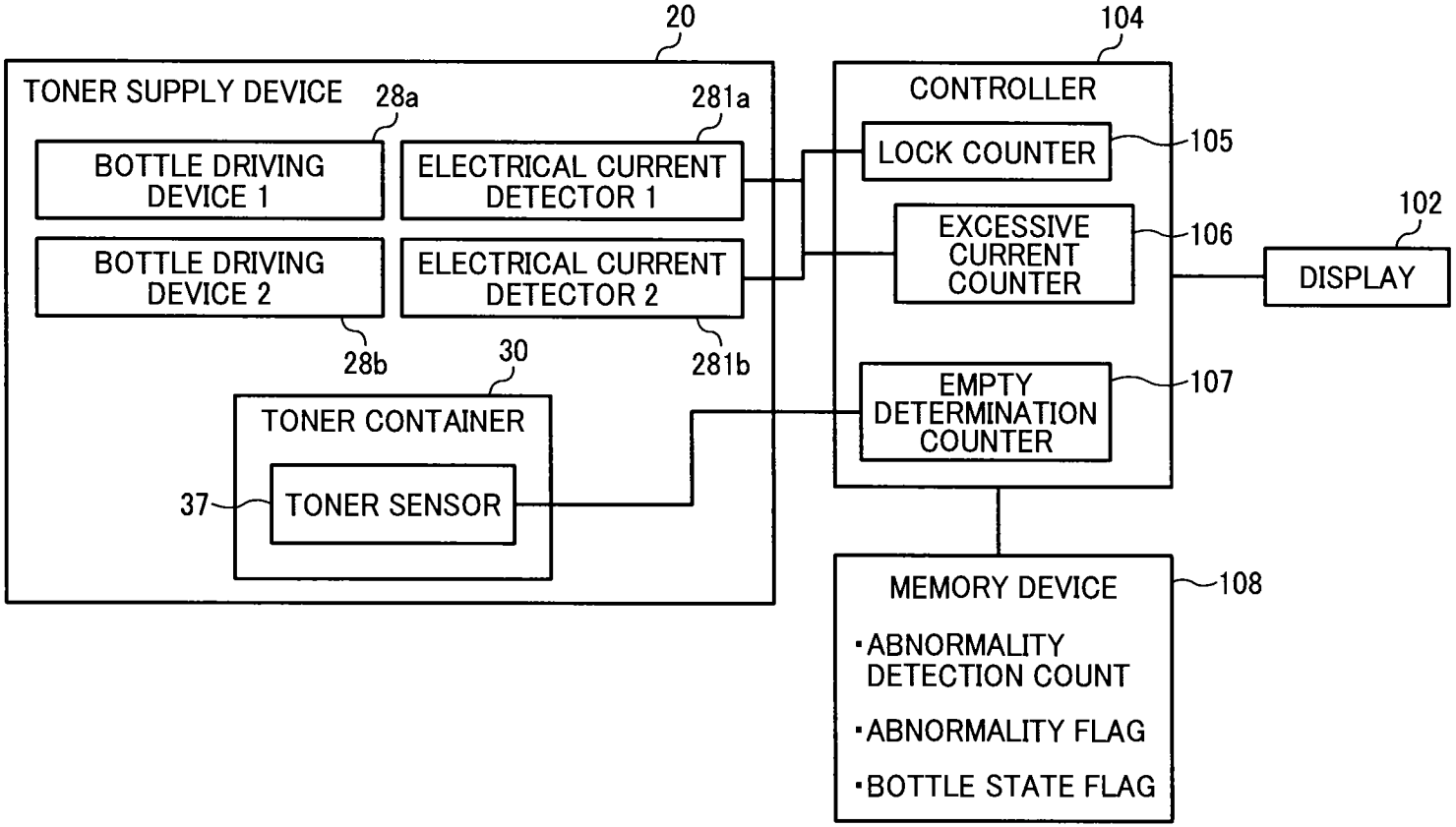
FIG. 10 is a control block diagram for controlling multiple bottle driving devices according to an embodiment.

The image forming apparatus 500 includes an abnormality detector (e.g., electrical current detectors 281*a* and 281*b* illustrated in FIG. 10) to acquire a driving status value (detection value) to determine whether or not the bottle driving device 28 is driving abnormally (in abnormal state) at regular intervals. The controller 104 compares the detection value with an abnormality criterial value, and the number of times the driving status value exceeds the abnormality criterial value is stored as an abnormality detection count in a memory device 108 (illustrated in FIG. 10). When the driving status value falls to or below the abnormality criterial value even once, the controller 104 resets the abnormality detection count stored in the memory device 108.

When the abnormality detection count exceeds the threshold number, the controller 104 determines that the bottle driving device 28 being driven is driving abnormally (i.e., a first abnormality phase) and stores the abnormality of the bottle driving devices 28 in the memory device 108. Further, the controller 104 reports (or indicates) the first abnormality phase.

The controller 104 determines the toner bottle 25 as empty when the toner bottle 25 is set (mounted) in the bottle driving device 28 having abnormality.

After determining that the toner bottle is empty (set in the bottle driving device 28 having abnormality), until the abnormality is removed, the controller 104 causes only the bottle driving device 28 operating normally to execute the toner supply and prevents the bottle driving device 28 having abnormality from executing the toner supply.

When both of the bottle driving devices 28 abnormality, the controller 104 reports (or indicates) that the bottle driving devices 28 are in a second abnormality phase and stops printing operation.

In short, in the case of abnormal driving of the toner bottle 25, the image forming apparatus 500 detects the abnormality early and reliably, stops the driving of the toner bottle 25, and reports (or indicates) the abnormality.

The bottle driving device 28 having abnormality does not operate in a period from the determination to until the abnormality is fixed, and only the bottle driving device 28 operating normally is used for the toner supply. Accordingly, the image forming apparatus 500 according to the present embodiment can continue printing even when the abnormality occurs.

Specifically, in the present embodiment, the overload of the bottle driving device 28 is detected, and, determining that the bottle driving device 28 has abnormality, the controller 104 stops the bottle driving device 28 and reports the abnormality.

However, even if the discharge of toner from the toner bottle 25 is suspended and the apparatus urges users to set (i.e., remount) the toner bottle 25 again upon the occurrence of abnormality, continuation of printing becomes unfeasible when the toner in a sub-hopper (i.e., the toner container 30) is used up.

Additionally, in a case where the abnormality is not fixed even after the toner bottle is remounted, printing is unfeasible until the defective unit is repaired.

In view of the foregoing, the toner supply device 20 is described in further detail below.

Embodiment 1

As illustrated in FIG. 3, the toner supply device 20 according to a first embodiment, includes the first and second bottle driving devices 28*a* and 28*b* (collectively "bottle driving devices 28") to drive the two toner bottles 25*a* and 25*b*, respectively, and the toner container 30 disposed below the bottle driving devices 28. The toner container 30 temporarily contains the toner discharged from the first and second the toner bottles 25*a* and 25*b*.

The toner supply device 20 further includes a toner supply tube 38 serving as a toner supply passage to supply toner from the toner container 30 to a toner supply opening 36. The toner supply passage is not limited to circular tube and pipes but can be rectangular or polygonal conduits.

The toner supply tube 38 projects from a center part of a bottom face of the toner container 30 in the direction of arrangement of the first and second the toner bottles 25*a* and 25*b*. The toner supply tube 38 projects in a direction parallel to the axial direction of the first and second the toner bottles 25*a* and 25*b* and extends below the first and second the toner bottles 25*a* and 25*b*.

Additionally, as illustrated in FIG. 4A, the upper side of the toner container 30 includes two toner inlets 34*a* and 34*b* (collectively "toner inlets 34") to receive the toner, as indicated by arrows A1 and A2 in FIG. 4A, discharged from the first and second the toner bottles 25*a* and 25*b*, respectively.

Below the toner inlets 34*a* and 34*b*, a first screw 31 is disposed in a lower part of the toner container 30. The first screw 31 is configured to transport the toner in the toner container 30 from below the toner inlets 34*a* and 34*b* to a center area in the direction in which the toner inlets 34*a* and 34*b* are arranged.

Specifically, the first screw 31 includes two screw portions arranged in the direction of the shaft of the first screw 31. The screw portions are opposite in screw winding direction to transport, by rotation, the toner in the opposite directions indicated by arrows B1 and B2.

Inside the toner supply tube 38, a second screw 33 is disposed to transport, by rotation, the toner from inside the toner container 30 to the toner supply opening 36. The second screw 33 includes a single screw portion winding in an identical direction.

The rotation axes of the first screw 31 and the second screw 33 are perpendicular to each other and disposed at different vertical positions, that is, disposed in different phases.

The toner container 30 further includes an agitator 32 (i.e., a stirring member) disposed in above the first screw 31, and the axis of rotation of the agitator 32 parallels the axis of rotation of the first screw 31.

Additionally, the toner sensor 37 is disposed on a wall of the toner container 30 to detect the toner contained inside the toner container 30.

The controller 104 of the printer body 100 samples outputs from the toner sensor 37 at predetermined sampling intervals.

One of the toner bottles 25 serves as a main bottle (i.e., the toner bottle 25 in use), which is used before the other toner bottle 25 is used. That is, the toner supply is started from the main bottle. When the controller 104 determines that no toner is present in the toner container 30 based on the sampled output, the main bottle and the agitator 32 are rotated, thereby supplying toner to the toner container 30.

It is to be noted that the controller 104 includes a central processing unit (CPU), a random access memory (RAM), a read only memory (ROM), and the memory device such as a silicon disc. The controller 104 controls the various parts of the image forming apparatus 500 and stores data according to programs.

Figure 5A:
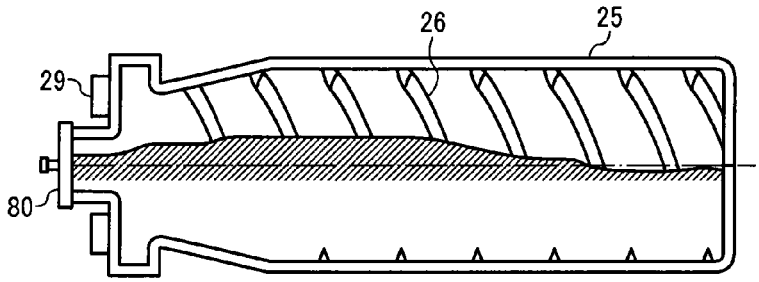
FIG. 5A is a cross-sectional view of a toner bottle mounted in the toner supply device illustrated in FIG. 3.
Figure 5B:
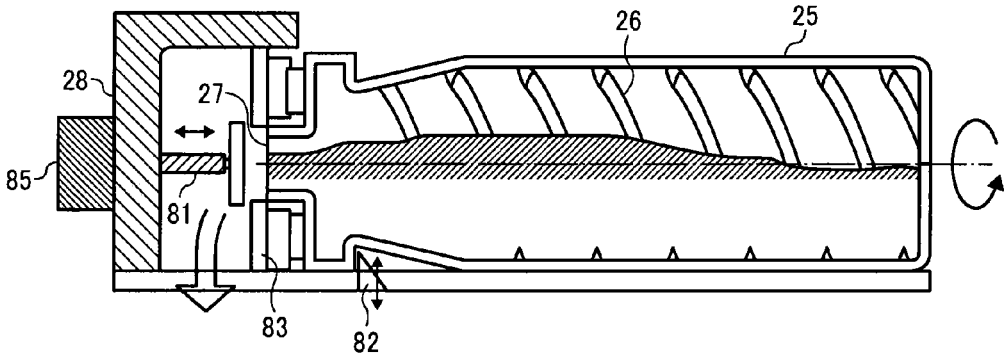
FIG. 5B is a cross-sectional view of a bottle driving device of the toner supply device illustrated in FIG. 3, with the toner bottle mounted therein.

FIG. 5A is a cross-sectional view of the toner bottle 25, and FIG. 5B is a cross-sectional view of the bottle driving device 28 and the toner bottle 25 mounted therein. Toner can be supplied from the toner bottle 25 being in the state illustrated in FIG. 5B.

It is to be noted that, although the two bottle driving devices 28 (28*a* and 28*b*) are provided for the toner container 30 of each color as described above, FIGS. 5A and 5B illustrate only one of the bottle driving devices 28 and one of the first and second the toner bottles 25*a* and 25*b*. The components given subscripts "a" and "b" are similar in configuration, and the subscripts "a" and "b" are omitted in FIGS. 5A and 5B and descriptions about the toner bottles 25 and the bottle driving devices 28 unless the discrimination therebetween is necessary.

As illustrated in FIG. 5A, the toner bottle 25 includes a spiral protrusion 26 disposed on an inner wall of the toner bottle 25 and a cap 80. As the toner bottle 25 itself rotates, the toner therein moves to one end of the toner bottle 25 and exits the toner bottle 25 from a toner outlet 27 at the end. This configuration can obviate a toner conveyor or the like.

As the toner bottle 25 is mounted in the bottle driving device 28, as illustrated in FIG. 5B, the controller 104 recognizes, with a bottle lock 82, that the toner bottle 25 in the bottle driving device 28.

The bottle driving device 28 includes a cap opener and closer 81 to open the cap 80 of the main bottle (the toner bottle 25 in use). The bottle lock 82 secures the main bottle not to be removed.

In the state in which the toner bottle 25 is set in the bottle driving device 28, a rib 29 of the toner bottle 25 engages a gear 83 of the bottle driving device 28.

As a bottle motor 85 of the bottle driving device 28 rotates the gear 83, the toner bottle 25 rotates. At least while the toner bottle 25 rotates, the controller 104 samples at regular intervals the output from the electrical current detector 281*a* or 281*b* (illustrated in FIG. 10) to detect the current value of the bottle motor 85.

When the toner bottle 25 becomes empty, the cap 80 is closed and the lock is released. Then, the toner bottle 25 is removable.

When the toner bottle 25 is removed from the bottle driving device 28, the controller 104 recognizes, with the bottle lock 82, that the toner bottle 25 is not in the bottle driving device 28.

When another toner bottle 25 (i.e., an auxiliary toner bottle) is in the bottle driving device 28 at the time at which the toner bottle 25 in use becomes empty, the cap 80 of the auxiliary toner bottle 25 is opened, and the auxiliary toner bottle 25 is locked.

Thus, even when both toner bottles 25 (main and auxiliary toner bottles) are set in the respective bottle driving devices 28, the cap 80 of only one toner bottle 25 (main bottle) is open, and toner can be supplied to the toner container 30 from the main bottle. The main bottle is locked not to be removed until the main bottle becomes empty.

Next, descriptions are given below of the method of determining that the toner bottle 25 is empty and switching of the main bottle (the bottle in use) between the two toner bottles 25.

Figure 6:
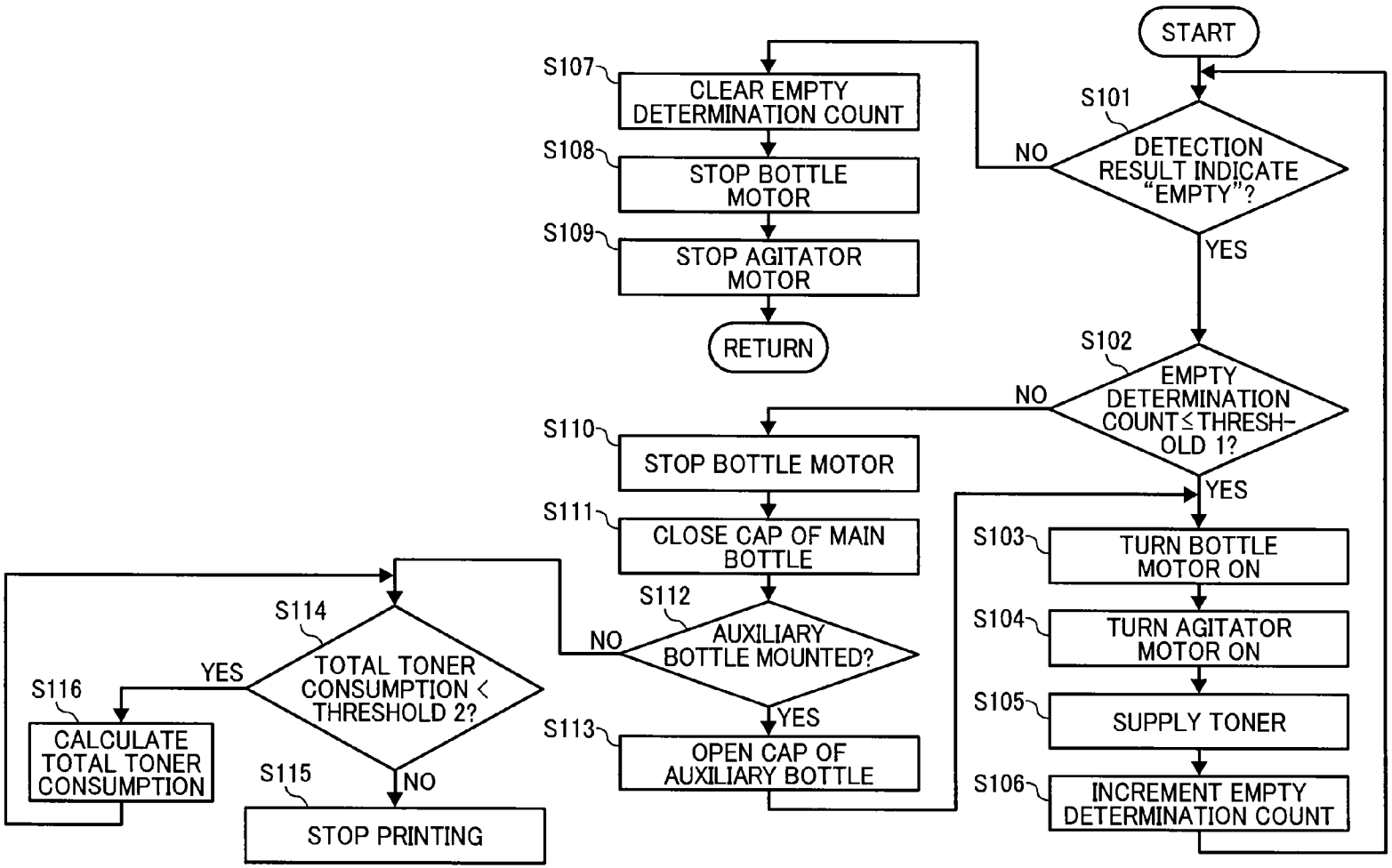
FIG. 6 is a flowchart of the method of determining that the toner bottle is empty and switching between the toner bottles, according to a first embodiment.

FIG. 6 is a flowchart of the method of determining that the toner bottle 25 is empty and switching between the toner bottles 25, and FIG. 10 is a control block diagram of a toner bottle driving device control method according to the present embodiment.

Referring to FIG. 10, the controller 104 includes a lock counter 105, an excessive current counter 106, and an empty determination counter 107 to count the number of times determination results indicates that the toner container 30 is "empty". Data related to the toner bottle driving device control is stored in the memory device 108.

While the image forming apparatus 500 performs printing with the toner bottles 25 mounted therein, at regular intervals (400 ms, for example), the toner sensor 37 of the toner container 30 transmits, to the controller 104, a detection result. At S101, the controller 104 determines whether or not the detection result indicates "empty".

When the detection result indicates "empty" (Yes at S101), at S102, the controller 104 checks whether or not a count value (i.e., "empty determination count") of the empty determination counter 107 is equal to or smaller than predetermined Threshold 1.

When the empty determination count is smaller than Threshold 1 of the empty determination count (Yes at S102), at S103, the controller 104 turns on the bottle motor 85 and an agitator motor. Thus, toner supply from the toner bottle 25 to the toner container 30 is started.

After the toner supply to the toner container 30 is started, at S106, the controller 104 increments the empty determination count (i=i+1).

By contrast, when the detection result does not indicates "empty" (No at S101), the controller 104 clears the empty determination count at S107 and stops the bottle motor 85 at S108 and the agitator motor at S109.

Subsequent to the increment of the empty determination count (S106), the process returns to the determination of whether or not toner is present in the toner container 30 (S101).

After the supply of toner from the toner bottle 25 (S103 through S106) is executed and the detection result of the toner sensor 37 indicates "empty" (Yes at S101), the process proceeds to step S102. When the empty determination count exceeds Threshold 1 (No at S202), the controller 104 determines that the main toner bottle 25 is empty.

Then, the controller 104 stops the bottle motor 85 to drive the main bottle at S110 and closes the cap 80 of the main bottle at S111. At S112, the controller 104 checks whether or not the auxiliary toner bottle 25 is mounted in the bottle driving device 28.

When the auxiliary toner bottle 25 is set in the bottle driving device 28 (Yes at S112), the cap opener and closer 81 opens the cap 80 of the auxiliary toner bottle 25 at S113. Then, the bottle motor 85 rotates the auxiliary toner bottle 25 (S103), and the agitator motor is driven (S104). Then, toner supply is started.

When the auxiliary toner bottle 25 is not set in the bottle driving device 28, printing is continued using the toner remaining in the toner container 30.

In the controller 104 according to the present embodiment, Threshold 2 is set in accordance with the amount of toner usable to when the toner container 30 becomes empty until and printing is inhibited by the shortage of toner supplied to the developing device 5.

At S114, the controller 104 compares Threshold 2 with a total toner consumption, serving as an end count value. The total toner consumption means the accumulative amount of toner used in printing and calculated from pixel data of the image to be printed. When the total toner consumption exceeds Threshold 2, the controller 104 stops printing at S115.

Specifically, in the state in which the auxiliary toner bottle 25 is not mounted in the apparatus (No at S112), while the total toner consumption is smaller than Threshold 2, the controller 104 adds, to the total toner consumption calculated previously, the amount of toner consumed in the subsequent image formation, thereby calculating the total toner consumption at S116. The steps S114 and S116 are repeated until the total toner consumption exceeds Threshold 2.

Next, descriptions are given below of abnormality determination method to determine the abnormality of the bottle driving devices 28.

Figure 7:
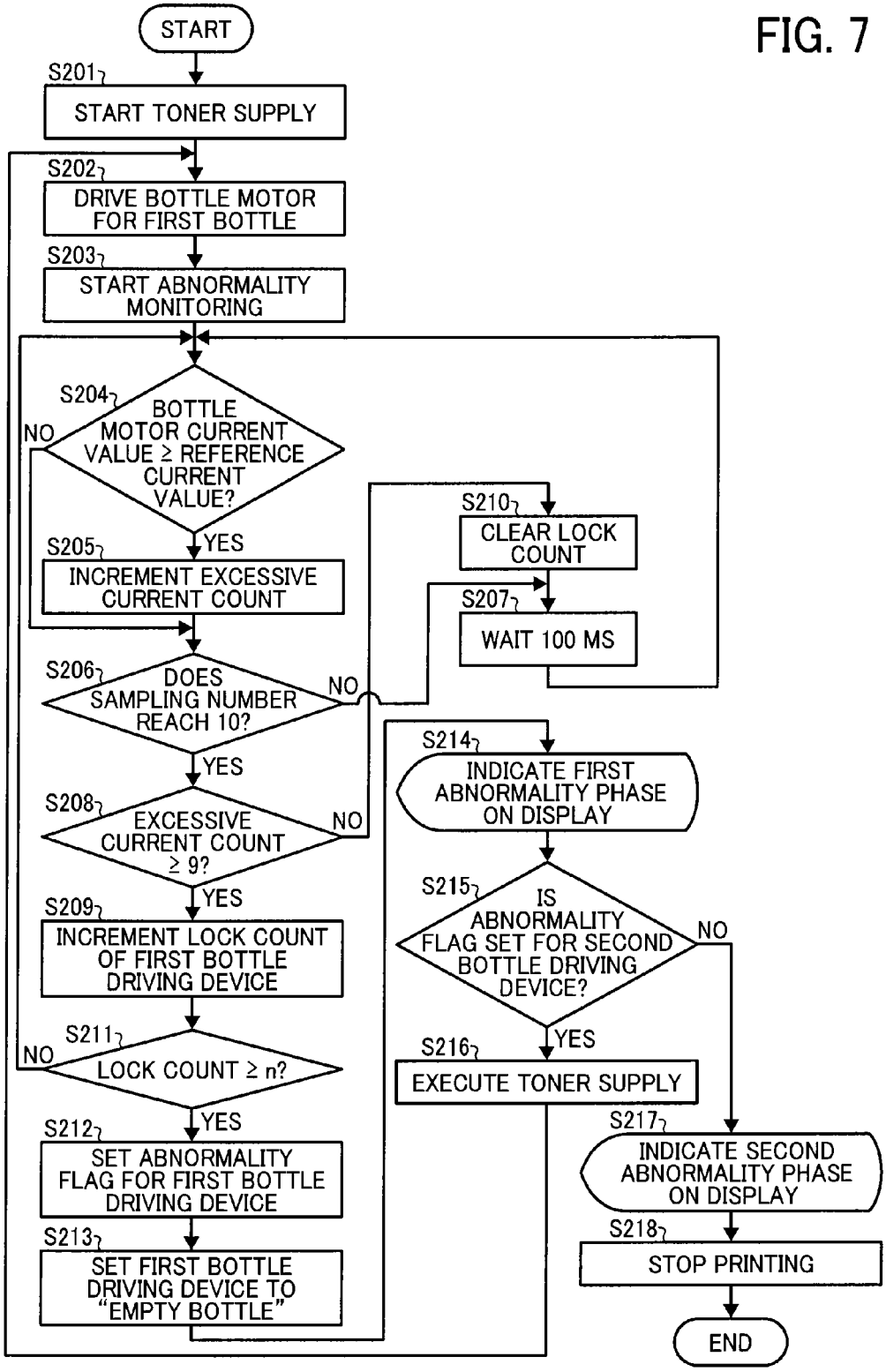
FIG. 7 is a flowchart of an abnormality determination method to determine abnormality of bottle driving devices according to a first embodiment.

FIG. 7 is a flowchart of the abnormality determination method according to the present embodiment.

The descriptions below are based on a state in which the first bottle driving device 28*a* is in use.

Determining that the toner supply is necessary, the controller 104 starts the toner supply to the toner container 30 at S201. At S202, the bottle motor 85*a* is driven to rotate the main bottle (the first toner bottle 25*a* in use)

At S203, the controller 104 starts abnormality monitoring. Specifically, while the bottle motor 85*a* is driven, at regular intervals, the controller 104 samples the current value of the bottle motor 85*a* (i.e., a bottle motor current value) detected by the electrical current detector 281*a* serving as the abnormality detector. The controller 104 compares the sampled current value with a reference current value.

For example, at intervals of 100 ms, the controller 104 compares the sampled current value with 600 mA serving as the reference current value at S204. When the sampled current value is equal to or greater than 600 mA (Yes at S204), at S205, the controller 104 increments, by one (+1), the excessive current count counted by the excessive current counter 106. Then, the controller 104 checks whether the number of sampling reaches 10 at S206. If the number of sampling has not yet reached 10 (No at S206), at S207, the interval of 100 ms is kept and the process returns to S204. The steps S204 to S208 are repeated until the number of sampling reaches 10.

When the number of sampling has reached 10 (Yes at S206), the process proceeds to S208. When the excessive current count is equal to or greater than 9 (Yes at S208), the controller 104 increments the lock counter 105 at S209. A lock count is increment by one. When the number of times the excessive current count is detected (lock count) is smaller than 9, the lock count is cleared at S210, and the process returns to S204.

After the lock count is incremented at S209, at S211 the controller 104 compares the lock count with an abnormality criterial value n.

When the lock count exceeds the abnormality criterial value n (Yes at S211), at S212, the controller sets an abnormality flag to "1", deeming that the first bottle driving device 28*a* is in a first abnormality phase.

When the lock count is smaller than the abnormality criterial value n (No at S211), the process returns to S204.

Thus, the bottle driving device 28 is determined as defective when the abnormality is continuously detected based on the comparison between the detected current value of the bottle motor 85 and the threshold. This determination is advantageous in avoiding erroneous determination of the abnormality based on the transient current at the start of driving or transient overload.

Although, in this method, toner is not supplied to the toner container 30 in the period till the controller 104 determines the abnormality, which is relatively long, the developing device 5 can be supplied with the toner from the toner container 30.

Accordingly, compared with a configuration in which the toner container 30 is not provided, inconveniences are smaller even if the time till the determination is longer.

However, as described above with reference to FIG. 6, the following inconvenience is possible in the method in which the toner bottle 25*a* is determined as empty when the monitored amount of toner in the toner container 30 does not increase even if the toner bottle 25*a* is driven for a given time period.

Unless the length of time till the abnormality determination is shorter than the length of time till the first toner bottle 25*a* is deemed empty, before the abnormality determination, the first toner bottle 25*a* is deemed empty, and the driving is switched to the second bottle driving device 28*b*.

To avoid such an inconvenience, the length of time till the lock count exceeds the abnormality criterial value n in the case where the overload of the bottle motor 85*a* continues is made shorter than the length of time till the empty determination count exceeds the threshold in the case where the empty state continues.

After the abnormality flag for the first bottle driving device 28*a* is set at S212, at S213, the controller 104 recognizes a mounted bottle status of the first bottle driving device 28*a* as "empty bottle" regardless of the amount of remaining toner in the first toner bottle 25*a*.

Specifically, the controller 104 sets a bottle state flag to a value corresponding to "empty bottle".

At S214, to controller indicates the abnormality (first abnormality phase) of the first bottle driving device 28*a* on the display device 102.

For example, the display device 102 indicates "Abnormality of Toner supply unit 1" and "Contact service center".

Thus, regarding the first toner bottle 25*a* as empty upon the occurrence of abnormality is advantageous in that, when the auxiliary toner bottle 25*b* is mounted in the second bottle driving device 28*b* (Yes at S215), the supply of toner can be continued at S216, similar to the case where the toner in the first toner bottle 25*a* is used up.

Accordingly, even when one of the bottle driving devices 28 has abnormality, printing is not stopped at that time but can be continued.

Additionally, even if the toner bottle 25*a* is remounted in the first bottle driving device 28*a* having abnormality, the toner bottle 25*a* is regarded as empty. Therefore, even when the toner bottle 25*b* mounted in the second bottle driving device 28*b* operating normally become empty, the first bottle driving device 28*a* is not driven but is kept unused until the abnormality is eliminated.

The abnormality of the other bottle driving device 28 (the second bottle driving device 28*b*) is detected similarly.

When both of the first and second bottle driving devices 28*a* and 28*b* are determined having abnormalities, that is, the second abnormality phase is recognized (No at S215), the second abnormality phase is indicated on the display device 102 at S217. The subsequent printing operation is inhibited at S218.

For example, the display device 102 indicates "Abnormality of toner supply unit" and "Contact service center", and the apparatus stops printing:

Next, descriptions are given below of recognition of bottle status at the time of setting the toner bottle 25 in the bottle driving device 28.

Figures 8, 8A:
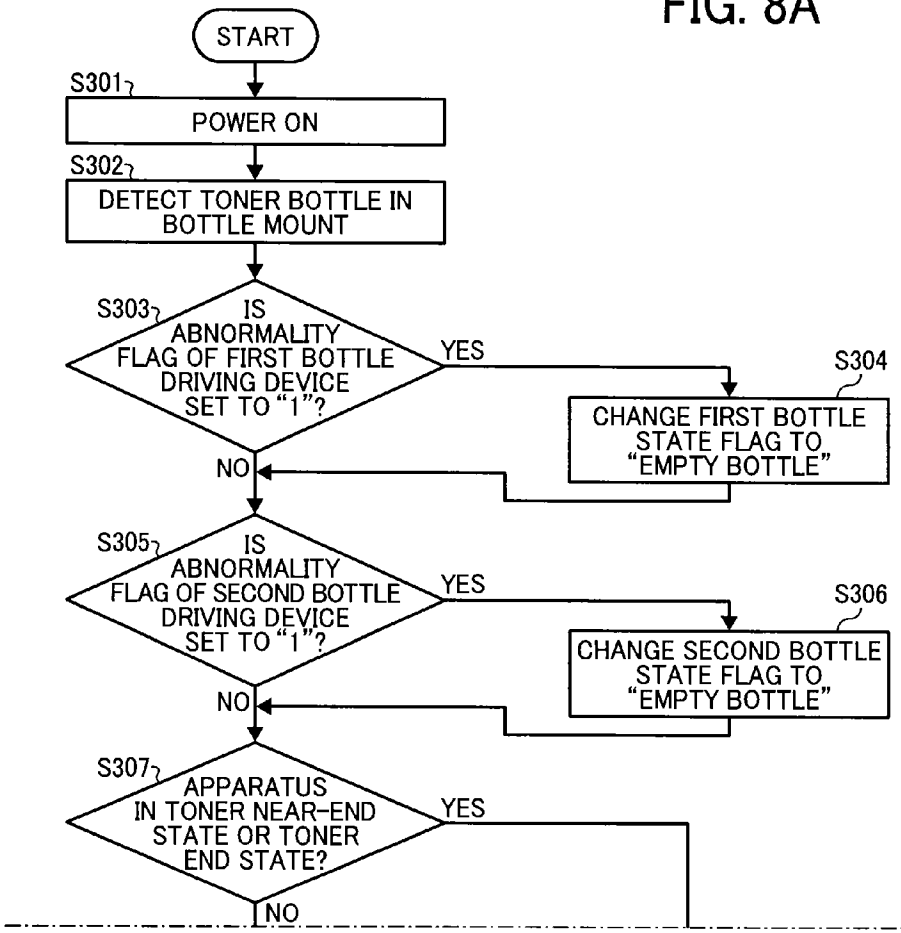
FIGS. 8A and 8B are flowcharts of recognition of bottle status upon setting of a toner bottle, according to the first embodiment.
Figure 8B:
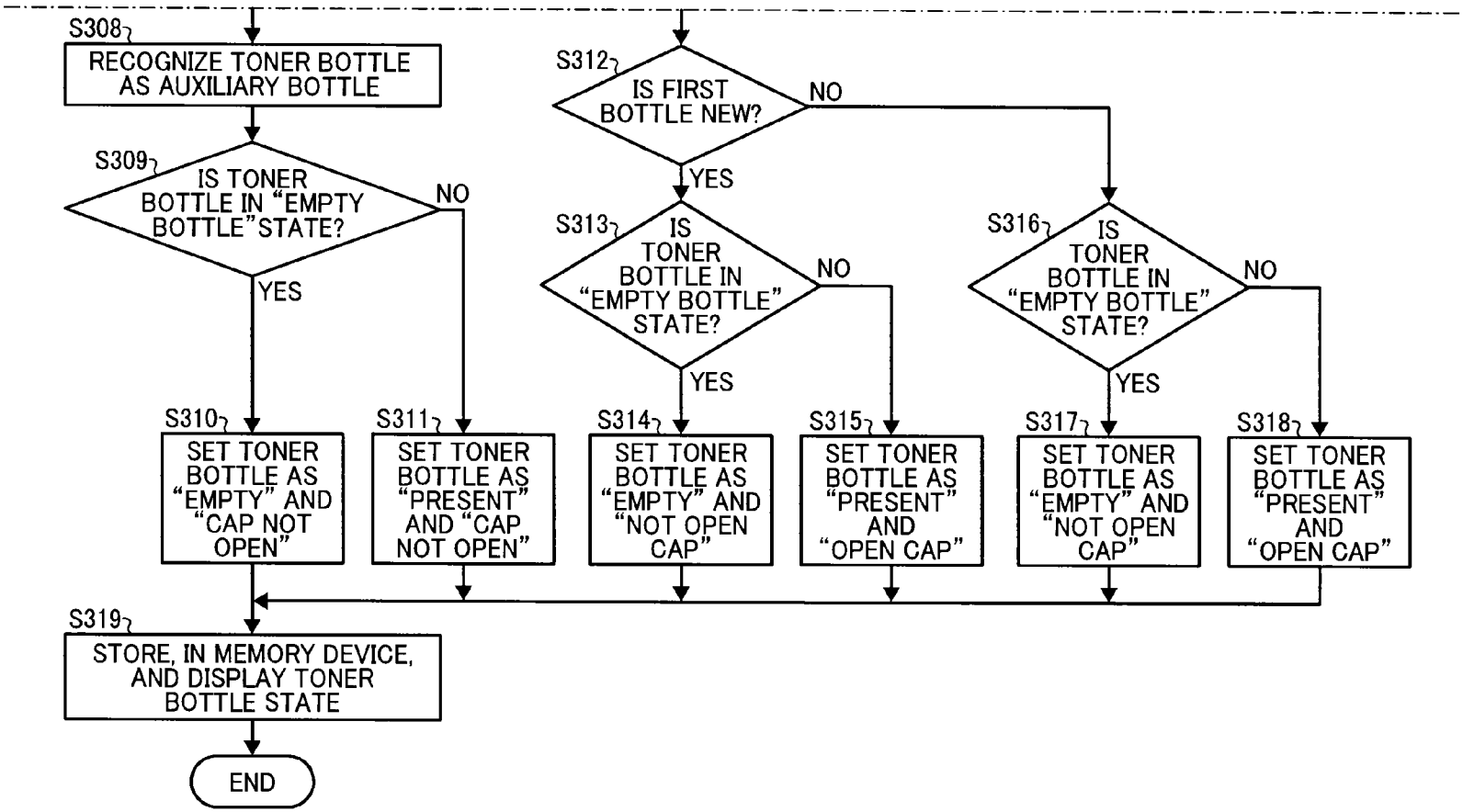

FIGS. 8A and 8B are flowcharts of recognition of bottle status at the time of setting the toner bottle 25.

At S301, while the power of the apparatus is on, the controller 104 checks whether or not the toner bottles 25 are mounted at S302. The controller 104 determines the status of new bottles mounted in the first and second bottle driving devices 28*a* and 28*b* based on the abnormality flag of the first and second bottle driving devices 28*a* and 28*b*.

Specifically, when a new toner bottle 25 is mounted (S302), the controller 104 refers to the abnormality flags (i.e., first abnormality phase flags) of the bottle driving devices 28. Specifically, at S303, the controller 104 checks whether the abnormality flag of the first bottle driving device 28*a* is set at "1" and, at S305, checks whether the abnormality flag of the second bottle driving device 28*b* is set at "1".

When the toner bottle 25 is set in the bottle driving device 28 being in the first abnormality phase (Yes at S303 or S305), the controller 104 sets the bottle state flag to "empty bottle" at S304 or S306.

At S307, the controller 104 determines whether or not the image forming apparatus 500 is a near-end state of toner or toner end state. When both of the first and second the toner bottles 25*a* and 25*b* are empty or not mounted in the bottle driving devices 28*a* and 28*b*, and toner is not supplied from neither of the first and second the toner bottles 25*a* and 25*b*, the apparatus is in the near-end state of toner. As printing is continued from the near-end state of toner, the toner remaining in the toner container 30 is used up. Then, printing becomes unfeasible unless a new toner bottle is mounted in the bottle driving device 28. Then, the apparatus is in the toner end state. When the apparatus is neither near-end state of toner nor toner end state (No at S307), at S308, the controller 104 recognizes the toner bottle 25 thus set in the bottle driving device 28 as the auxiliary bottle.

At S309, the controller 104 determines whether or not the bottle state flag of the auxiliary toner bottle thus set indicates "empty bottle".

Since the auxiliary toner bottle being in the bottle driving device 28 having abnormality is recognized as "empty bottle" (Yes at S309), the bottle driving device 28 having abnormality is not driven.

Additionally, at S310, the controller 104 recognizes the status of the toner bottle 25 as "empty bottle" and "not open cap". At S319, the toner bottle state is stored in the memory device such as the silicon disc, and the display device 102 displays the status.

By contrast, when the toner bottle 25 is in the bottle driving device 28 operating normally and the status thereof is not "empty bottle" (No at S309), at S311, the controller 104 recognizes the status of the toner bottle 25 as "present" and "not open cap". At S319, the status of the toner bottle 25 is stored in the memory device 108 and indicated.

When the apparatus is either in the near-end state of toner or toner end state (Yes at S307), at S312, the controller 104 determines whether the first toner bottle 25*a* (right bottle) is new.

When the new bottle is set as the first toner bottle 25*a* (Yes at S312), at S313, the controller 104 determines whether or not the bottle state flag of the first toner bottle 25*a* indicates "empty bottle".

Since the toner bottle 25 being in the bottle driving device 28 having abnormality is recognized as "empty bottle" (Yes at S313), the bottle driving device 28 having abnormality is not driven.

Additionally, at S314, the controller 104 recognizes the status of the toner bottle 25 as "empty bottle" and "not open cap". At S319, the status of the toner bottle 25 is stored in the memory device 108 and indicated on the display device 102.

By contrast, when the toner bottle 25 is in the bottle driving device 28 operating normally and the status thereof is not "empty bottle" (No at S313), at S315, the controller 104 recognizes the status of the toner bottle 25 as "present" and "open cap". At S319, the status of the toner bottle 25 is stored in the memory device 108 and indicated on the display device 102.

When the new bottle is set as the second toner bottle 25*b* or the left bottle (No at S312), at S316, the controller 104 determines whether or not the bottle state flag of the second toner bottle 25*b* indicates "empty bottle".

Since the toner bottle 25 being in the bottle driving device 28 having abnormality is recognized as "empty bottle" (Yes at S316), the bottle driving device 28 having abnormality is not driven.

Additionally, at 5317, the controller 104 recognizes the status of the toner bottle 25 as "empty bottle" and "not open cap". At S319, the status of the toner bottle 25 is stored in the memory device 108 and indicated on the display device 102.

By contrast, when the toner bottle 25 is in the bottle driving device 28 operating normally and the status thereof is not "empty bottle" (No at S316), at 5318, the controller 104 recognizes the status of the toner bottle 25 as "present" and "open cap". At S319, the status of the toner bottle 25 is stored in the memory device 108 and indicated on the display device 102.

Thus, when a new toner bottle is set in the bottle driving device 28 having abnormality, the new toner bottle is considered to be empty. Accordingly, the bottle driving device 28 having abnormality does not operate even when a new toner bottle is not set in the bottle driving device 28 operating normally or the toner bottle 25 in the bottle driving device 28 operating normally becomes empty.

Therefore, toner is supplied to the toner container 30 using only the bottle driving device 28 operating normally.

Embodiment 2

A second embodiment described below is different from the first embodiment in that the first abnormality phase and the second abnormality phase are indicated differently on the display device 102 and subsequent actions (control operation) is different. Other than that, the second embodiment is similar to the first embodiment.

Accordingly, descriptions are given below of the method of determining the abnormality of the bottle driving devices 28, and the structure and effects similar to those of the first embodiment are omitted.

Figure 9:
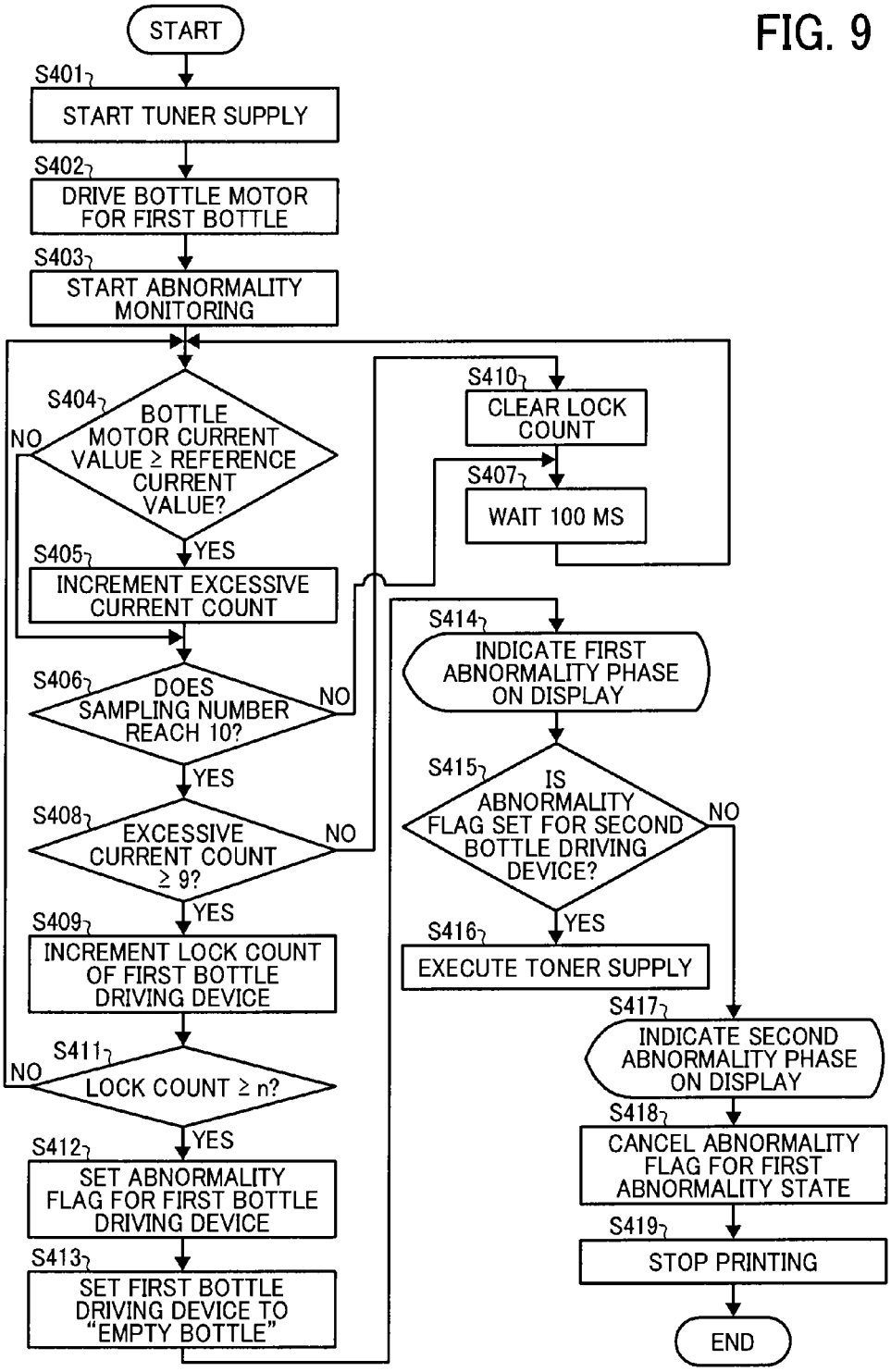
FIG. 9 is a flowchart of an abnormality determination method of bottle driving devices according to a second embodiment.

FIG. 9 is a flowchart of the abnormality determination method to determine the abnormality of the bottle driving devices 28 according to the second embodiment.

As described above, the causes of overload include the occurrence of toner aggregations not resolved by continuous driving of the toner bottle driving device 28 and lingering defects such as damage of the driving mechanism. However, it is possible that the abnormality is caused by improper setting of the toner bottle 25 or the like and the toner bottle driving device 28 is not defective. In such a case, the abnormality is resolved by remounting the toner bottle 25 or rocking (vibrating) the toner bottle 25.

In the first embodiment, in the case where all of multiple toner bottle driving devices (two in the present embodiment) are determined as abnormal, the user requests the service center for repair even when the abnormality is resolved by remounting the toner bottle 25. In this case, the downtime in which image formation is unfeasible is long.

In view of the foregoing, the inventors have found the following method to enable the user to resolve a minor abnormality without calling the service center even when the multiple bottle driving devices have abnormality.

Similar to the first embodiment, the descriptions below are based on a state in which the first bottle driving device 28*a* of the two bottle driving devices 28 is in use.

Determining that the toner supply is necessary, the controller 104 starts the toner supply to the toner container 30 at S401. At S402, the bottle motor 85*a* is driven to rotate the main bottle (first toner bottle 25*a* in use)

At S403, the controller 104 starts abnormality monitoring. Specifically, while the bottle motor 85*a* is driven, at regular intervals, the controller 104 samples the current value of the bottle motor 85*a* (bottle motor current value), which is detected by the electrical current detector 281*a* serving as the abnormality detector. The controller 104 compares the sampled current value with a reference current value.

For example, at intervals of 100 ms, the controller 104 compares the sampled current value with 600 mA serving as the reference current value at S404. When the sampled current value is equal to or greater than 600 mA (Yes at S404), the controller 104 increments the excessive current count by one (+1) at S405. Then, the controller 104 checks whether the number of sampling reaches ten. The steps S404 to S408 are repeated until the number of sampling reaches ten. When the excessive current count is equal to or greater than 9 (Yes at S408), at S409, the controller 104 increments by one the lock count, which is counted by the lock counter 105. When the number of times the excessive current count is detected (lock count) is smaller than 9, the lock count is cleared at 5410, and the process returns to S404.

After the lock count is incremented at S409, at S411 the controller 104 compares the lock count with an abnormality criterial value n. When the lock count exceeds the abnormality criterial value n (Yes at S411), at S412, the controller 104 sets the abnormality flag to "1", deeming that the first bottle driving device 28*a* is in a first abnormality phase.

When the lock count is smaller than the abnormality criterial value n (No at S411), the process returns to S404.

In the abnormality of the first bottle driving device 28*a* (Yest at S411), after setting the abnormality flag of the first bottle driving device 28*a* to "1", at S413, the controller 104 regards the bottle status in the first bottle driving device 28*a* as "empty bottle" regardless of the amount of remaining toner.

At S414, the display device 102 indicates the first abnormality phase of the first bottle driving device 28*a*. For example, the display device 102 indicates "Abnormality of Toner supply unit 1". That is, determining that the first bottle driving device 28*a* has abnormality, the controller 104 stores that the first bottle driving device 28*a* is in the first abnormality phase in the memory device 108 and displays the first abnormality phase on the display device 102.

Thus, regarding the toner bottle 25*a* as empty upon the occurrence of abnormality is advantageous in that, when the auxiliary toner bottle 25*b* is mounted in the second bottle driving device 28*b* (Yes at S415), the supply of toner can be continued (S416), similar to the case where the toner in the toner bottle 25*a* is used up. Accordingly, even when one of the bottle driving devices 28 has abnormality, printing is not stopped at that time but can be continued.

Additionally, even if the toner bottle 25*a* is remounted in the first bottle driving device 28*a* having abnormality, the toner bottle 25*a* is regarded as empty. Therefore, even when the toner bottle 25*b* mounted in the second bottle driving device 28*b* operating normally become empty, the first bottle driving device 28*a* is not used but is kept unused until the abnormality is eliminated.

The abnormality of the other bottle driving device 28 (second bottle driving device 28*b*) is detected similarly. When both of the first and second bottle driving devices 28*a* and 28*b* are determined as abnormal, that is, the second abnormality phase is recognized (No at S415), the second abnormality phase is indicated on the display device 102 at S417. For example, the display device 102 indicates "Abnormality of Toner supply units 1 and 2" and the apparatus stops printing.

At S418, the controller 104 changes the value of a first abnormality flag from "1", which indicates the first abnormality phase of the bottle driving devices 28, to "0", which indicates that the bottle driving devices 28 are normal. At S419, the controller 104 inhibits subsequent printing.

Subsequently, by turning off and on the image forming apparatus 500, the toner supply is resumed at S401.

At the time of power-on, the abnormality flag of the bottle driving devices 28*a* and 28*b* has been rewritten to "0". Therefore, detection of abnormality of the bottle driving devices 28*a* and 28*b* is executed (hereinafter "automatic recovery").

The automatic recovery including rewriting the abnormality flag to "0" upon the power on is performed when both of the bottle driving devices 28*a* and 28*b* are determined as abnormal. That is, the automatic recovery is not performed when only one of the bottle driving devices 28*a* and 28*b* has abnormality.

However, for example, when the user calls the service center for repair, in the image forming apparatus 500, the automatic recovery can be executed forcibly by pressing a reset button or the like.

With this configuration, the following effects are attained.

In the case where one of the bottle driving devices 28*a* and 28*b* is in the first abnormality phase, the abnormality flag is not canceled by turning off and on the image forming apparatus 500. The abnormality flag is canceled by turning off and on the image forming apparatus 500 when both of the bottle driving devices 28*a* and 28*b* are in the first abnormality phase. With this configuration, when the bottle driving devices 28*a* and 28*b* enter the second abnormality phase, the user can cancel the abnormality flag indicating the first abnormality phase by turning off and on the image forming apparatus 500 without calling the service center. This manner of canceling the abnormality flag enables resumption of printing without calling the service center for repair when the abnormality of at least one of the bottle driving devices 28 is solvable without repairing the bottle driving devices 28.

Therefore, the request to the service center for repair is necessary only when the second abnormality phase is reported after the image forming apparatus 500 is restarted (power is turned off and on). Thus, the downtime of the image forming apparatus 500 is significantly reduced.

It is to be noted that, in the present embodiment, before the power is turned off, the abnormality flag indicating the first abnormality phase is rewritten with the value indicating normal. However, the manner to rewrite the abnormality flag is not limited thereto. For example, the value of the abnormality flag indicating the second abnormality phase is stored, and, in a case where the bottle driving devices 28 are in the second abnormality phase at the time of power-on, the value of the abnormality flag indicating both of the first abnormality phase and the second abnormality phase can be rewritten with the values each indicating the normal state. Similar effects are available in this case.

Additionally, although the descriptions above concern the toner supply device 20 provided with the two bottle driving devices 28, the aspects of this disclosure are not limited thereto. For example, the aspects of this disclosure are applicable to a toner filling device provided with multiple bottle driving devices separately from the toner supply device 20. In such a configuration, the toner filling device supplies toner from multiple toner bottles to the toner container 30 of the toner supply device 20.

The various configurations according to the present inventions can attain specific effects as follows.

Aspect A

Aspect A concerns a method of controlling multiple toner bottle driving devices (e.g., the bottle driving devices 28*a* and 28*b*) connected to a single toner container (e.g., the toner container 30). Each of the multiple toner bottle driving devices contains a toner bottle. The method includes a step of driving one (i.e., a driving device being driven) of the multiple toner bottle driving devices; a step of determining whether or not there is at least one drivable toner bottle driving device containing a non-empty toner bottle when the toner bottle in the driving device being driven is determined as empty; a step of driving the drivable toner bottle driving device, if any, instead of the toner bottle driving device containing the toner bottle determined as empty; and a step of determining whether or not the driving device being driven has abnormality.

The method further includes a step of detecting a driving status value (e.g., electrical current detected by the electrical current detector 281*a* or 281*b*) of the toner bottle driving device being driven at regular intervals to determine the abnormality of the toner bottle driving device being driven; a step of storing, as an abnormality detection count, the number of times the driving status value exceeds an abnormality criterial value in the memory device 108; a step of resetting the abnormality detection count when the driving status value falls to or below the abnormality criterial value even once; a step of determining that the driving device being driven is in a first abnormality phase when the stored abnormality detection count exceeds a threshold; a step of storing, in the memory device, the first abnormality phase as a status of the driving device being driven; a step of indicating the first abnormality phase of the driving device being driven on a display of an image forming apparatus including the multiple toner bottle driving devices; a step of determining that the toner bottle in the toner bottle driving device being in the first abnormality phase is empty regardless of the amount of remaining toner therein; a step of inhibiting the toner bottle driving device being in the first abnormality phase from driving until the first abnormality phase is resolved; a step of driving the drivable toner bottle driving device; a step of determining that the multiple toner bottle driving devices are in a second abnormality phase when all of the multiple bottle driving devices enter the first abnormality phase; a step of indicating the second abnormality phase on the display; and a step of inhibiting image forming operation such as printing until the second abnormality phase is resolved.

With this aspect, as described in the embodiments, when it is determined that the rotating toner bottle is empty, the driving device being driven can be switched among the multiple toner bottle driving devices connected to the single toner container, and the toner bottle in use can be switched among the multiple toner bottles sequentially.

When the abnormality detection count exceeds the threshold, the first abnormality phase of the driving device being driven is determined and indicated. Then, it is determined that the toner bottle that has been rotated is empty regardless of the amount of toner remaining therein. When all of the multiple bottle driving devices connected to the single toner container enter the first abnormality phase, the second abnormality phase of the multiple toner bottle driving devices is determined. The image forming operation is inhibited until the second abnormality phase is resolved.

Accordingly, the abnormality of the multiple toner bottle driving devices (hereinafter "a set of toner bottle driving devices") connected to the single toner container can be detected early and properly. The set of toner bottle driving devices and the image forming apparatus are controlled based on the determination result, and image formation is made feasible by switching between the multiple toner bottle driving devices while the toner bottle is replaced.

Aspect B

In Aspect A, the driving status value of the driving device being driven, detected at regular intervals, is the current value flowing to a driving motor (e.g., the bottle motor 85) of the driving device being driven.

With this aspect, as described in the embodiments, the abnormality of the toner bottle driving device can be determined without providing a sensor dedicated for detecting overload of the toner bottle driving device.

Accordingly, the cost of the toner bottle driving devices and the device incorporating the multiple toner bottle driving devices can be reduced.

Aspect C

The method according to Aspect A or B further includes a step of determining whether or not the memory device stores the first abnormality phase regarding the multiple toner bottle driving devices when to new toner bottle is mounted in one of the multiple toner bottle driving devices; a step of determining that the new toner bottle mounted is empty regardless of the amount of remaining toner therein when the toner bottle driving device in which the new toner bottle is mounted is in the first abnormality phase; a step of storing a status (i.e., empty bottle) of the replaced toner bottle in the memory device, and a step of indicating the status of the replaced toner bottle on the display.

With this aspect, as described in the embodiments, since the new toner bottle mounted in the bottle driving device having abnormality is determined as empty, the bottle driving device having abnormality does not operate when the new toner bottle is not set in the bottle driving device operating normally or even when the toner bottle in the bottle driving device operating normally becomes empty.

Therefore, toner is supplied to the toner container using only the bottle driving device operating normally.

Aspect D

The method according to any one of Aspects A through C further includes a step of rewriting a status value of the toner bottle driving device stored in the memory device from a value indicating the first abnormality phase to a status value indicating normal after the second abnormality phase is indicated on the display.

With this aspect, as described in the embodiments, the first abnormality flag indicating the first abnormality phase is not canceled by turning off and on the image forming apparatus when a part of the set of bottle driving devices is in the first abnormality phase, but is canceled by turning off and on the image forming apparatus when all the bottle driving devices are in the first abnormality phase. With this configuration, when the bottle driving devices 28*a* and 28*b* enter the second abnormality phase, the user can cancel the abnormality flag indicating the first abnormality phase by turning off and on the image forming apparatus 500 without calling the service center. This manner of canceling the abnormality flag enables resumption of printing without calling the service center for repair when the abnormality of the bottle driving devices is solvable without repairing the bottle driving devices.

Therefore, the request to the service center for repair is necessary only when the second abnormality phase is reported after the image forming apparatus is restarted (power is turned off and on). Thus, the downtime of the image forming apparatus is significantly reduced.

It is to be noted that the first and second abnormality phases may be used indicated by separate flags (i.e., first and second abnormality phase flags).

Aspect E

Aspect E concerns a toner filling device to supply toner to the toner container (e.g., the toner container 30). The toner filling device drives one of the multiple toner bottle driving devices (e.g., the bottle driving devices 28*a* and 28*b*) connected to the toner container and drives a drivable toner bottle driving device, if any; among the multiple driving devices, in a case where there is at least one drivable toner bottle driving device in which a non-empty toner bottle is mounted, either when the toner bottle in the driving device being driven is determined as empty or when the driving device being driven has abnormality. The toner filling device employs the method according to any one of Aspects A through D.

This aspect attains effects similar to those attained by Aspects A through D.

Aspect F

Aspect F concerns a toner supply device (e.g., the toner supply device 20) to supply toner to a developing device (e.g., the developing device 5). The toner supply device drives one of the multiple toner bottle driving devices (e.g., the bottle driving devices 28*a* and 28*b*) connected to the developing device and drives a drivable toner bottle driving device, if any; among the multiple driving devices, in a case where there is at least one drivable toner bottle driving device containing a non-empty toner bottle either when it is determined that the toner bottle in the driving device being driven is empty or when the driving device being driven has abnormality. The toner supply device employs the method according to any one of Aspects A through D.

This aspect attains effects similar to those attained by Aspects A through D.

Aspect G

Aspect G concerns an image forming apparatus that includes the toner supply device according to Aspect F to supply toner from multiple toner bottles (e.g., the first and second the toner bottles 25*a* and 25*b*) to the developing device.

This aspect attains effects similar to those attained by Aspect E.

It is to be noted that the steps in the above-described flowcharts may be executed in an order different from those in the flowcharts. Further, elements, features, or elements and features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

Numerous additional modifications and variations are possible in light of the above teachings. It is therefore to be understood that, within the scope of the appended claims, the disclosure of this patent specification may be practiced otherwise than as specifically described herein.

What is claimed is:

1. A toner bottle driving device control method comprising:

driving one of multiple toner bottle driving devices connected to a single toner container at a time, the multiple toner bottle driving devices to drive toner bottles, respectively;

detecting a driving status value of a toner bottle driving device being driven, out of the multiple toner bottle driving devices, at regular intervals;

storing, in a memory device, an abnormality detection count representing a count of times when the driving status value exceeds an abnormality criterial value;

resetting the abnormality detection count when the driving status value falls to or below the abnormality criterial value;

determining that the toner bottle driving device being driven is in a first abnormality phase when the stored abnormality detection count exceeds a threshold;

storing the first abnormality phase as a status of the toner bottle driving device being driven in the memory device;

indicating the first abnormality phase of the toner bottle driving device being driven on a display of an image forming apparatus including the multiple toner bottle driving devices;

determining that a toner bottle contained in the toner bottle driving device being in the first abnormality phase is empty regardless of an amount of toner remaining in the toner bottle;

inhibiting the toner bottle driving device being in the first abnormality phase from driving until the first abnormality phase is resolved;

driving a drivable toner bottle driving device containing a non-empty toner bottle, out of the multiple toner bottle driving devices when the toner bottle contained in the toner bottle driving device being driven is determined as empty;

determining that the multiple toner bottle driving devices are in a second abnormality phase when the memory device stores the first abnormality phase as the status of each of the multiple toner bottle driving devices;

indicating the second abnormality phase on the display; and inhibiting image forming in the image forming apparatus until the second abnormality phase is resolved.

2. The toner bottle driving device control method according to claim 1, wherein the detecting the driving status value includes detecting an electrical current value flowing to a driving motor of the toner bottle driving device being driven.

3. The toner bottle driving device control method according to claim 1, further comprising:

determining whether or not the memory device stores the first abnormality phase as the status of each of the multiple toner bottle driving devices when a new toner bottle is mounted in one of the multiple toner bottle driving devices;

determining that the new toner bottle is empty regardless of an amount of remaining toner in the new toner bottle when the memory device stores the first abnormality phase as the status of the toner bottle driving device in which the new toner bottle is mounted;

storing, in the memory device, a bottle status indicating that the new toner bottle is empty; and indicating the bottle status on the display.

4. The toner bottle driving device control method according to claim 1, wherein the storing the first abnormality phase includes setting a first abnormality phase flag in the memory device, and the method further comprises cancelling the first abnormality phase flag after the display indicates the second abnormality phase.

5. A toner bottle driving device control method comprising:

driving one of multiple toner bottle driving devices connected to a single toner container at a time, the multiple toner bottle driving devices to drive toner bottles, respectively;

detecting whether a toner bottle driving device being driven, out of the multiple toner bottle driving devices, has an abnormality at regular intervals;

determining that the toner bottle driving device being driven is in a first abnormality phase when a number of times the abnormality of the toner bottle driving device is detected exceeds a threshold;

inhibiting the toner bottle driving device being in the first abnormality phase from driving until the first abnormality phase is resolved;

driving a drivable toner bottle driving device containing a non-empty toner bottle, out of the multiple toner bottle driving devices, when the toner bottle contained in the toner bottle driving device being driven is determined as empty;

determining that the multiple toner bottle driving devices are in a second abnormality phase when each of the multiple toner bottle driving devices is determined as being in the first abnormality phase; and inhibiting image formation in an image forming apparatus including the multiple toner bottle driving devices.

6. The toner bottle driving device control method according to claim 5, wherein the detecting the abnormality comprises detecting a driving status value of the toner bottle driving device being driven at regular intervals.

7. The toner bottle driving device control method according to claim 6, further comprising storing an abnormality detection count representing a count of times the driving status value exceeds an abnormality criterial value.

8. The toner bottle driving device control method according to claim 7, further comprising resetting the stored abnormality detection count when the detected driving status value falls to or below the abnormality criterial value.

9. The toner bottle driving device control method according to claim 5, further comprising indicating the first abnormality phase of the toner bottle driving device being driven on a display of the image forming apparatus including the multiple toner bottle driving devices.

10. The toner bottle driving device control method according to claim 5, further comprising indicating the second abnormality phase of the toner bottle driving device being driven on a display of the image forming apparatus including the multiple toner bottle driving devices.

11. An image forming apparatus comprising:

a single toner container to contain toner;

multiple toner bottle driving devices connected to the single toner container, the multiple toner bottle driving devices to drive toner bottles, respectively;

a controller to control driving of the multiple toner bottle driving devices;

an abnormality detector to detect an abnormality of a toner bottle driving device being driven, out of the multiple toner bottle driving devices, wherein the controller determines that the toner bottle driving device being driven is in a first abnormality phase when a number of times the abnormality detector detects the abnormality of the toner bottle driving device being driven exceeds a threshold, the controller stops the bottle driving device being in the first abnormality phase and drives a drivable toner bottle driving device out of the multiple toner bottle driving devices, and when each of the multiple toner bottle driving devices is in the first abnormality phase, the controller determines that the multiple toner bottle driving devices are in a second abnormality phase and inhibits image formation in the image forming apparatus.

* * * * *